US008701904B2

(12) United States Patent
Roodenburg et al.

(10) Patent No.: US 8,701,904 B2
(45) Date of Patent: Apr. 22, 2014

(54) CRANE VESSEL

(75) Inventors: Joop Roodenburg, Delft (NL); Theodorus Cornelis Joanes Maria Stijnman, He Gouda (NL); Hendrikus Jacobus Weterings, DX 's-Gravenzande (NL)

(73) Assignee: Itrec B.V., Schiedam (NL)

( * ) Notice: Subject to any disclaimer, the term of this patent is extended or adjusted under 35 U.S.C. 154(b) by 702 days.

(21) Appl. No.: 12/811,026

(22) PCT Filed: Jan. 14, 2009

(86) PCT No.: PCT/NL2009/000005

§ 371 (c)(1),
(2), (4) Date: Jul. 23, 2010

(87) PCT Pub. No.: WO2009/099319

PCT Pub. Date: Aug. 13, 2009

(65) Prior Publication Data

US 2010/0294737 A1 Nov. 25, 2010

(30) Foreign Application Priority Data

Feb. 7, 2008 (EP) ..... 08075096

(51) Int. Cl.
*B66C 23/26* (2006.01)
*B66C 23/52* (2006.01)

(52) U.S. Cl.
USPC ..... 212/294; 212/307; 212/175; 212/259

(58) Field of Classification Search
USPC ..... 212/175, 294–296, 270, 307–310, 326, 212/327, 300, 242–243, 259
See application file for complete search history.

(56) References Cited

U.S. PATENT DOCUMENTS

| | | | | |
|---|---|---|---|---|
| 2,831,592 | A * | 4/1958 | Syracuse | 414/607 |
| 4,343,458 | A * | 8/1982 | Simon | 254/399 |
| 2001/0002010 | A1 * | 5/2001 | Franzen et al. | 212/325 |

FOREIGN PATENT DOCUMENTS

| | | | |
|---|---|---|---|
| CN | 2615042 | Y | 5/2004 |
| EP | 260112 | A2 * | 3/1988 |
| EP | 0 408 111 | A1 | 1/1991 |
| EP | 1084984 | A1 | 3/2001 |
| EP | 1765717 | A | 3/2007 |
| NL | 8403467 | A | 6/1986 |
| WO | WO 2005/123566 | A2 | 12/2005 |
| WO | WO 2005123566 | A2 * | 12/2005 |

* cited by examiner

*Primary Examiner* — William E Dondero
*Assistant Examiner* — Nathaniel Adams
(74) *Attorney, Agent, or Firm* — Birch, Stewart, Kolasch & Birch, LLP

(57) ABSTRACT

A crane vessel including a revolving hoist crane and a method of using such a vessel are provided. The hoist crane includes a jib, main hoisting means and auxiliary hoisting means for raising and lowering a load. The main hoisting means include a main hoisting tackle with a main hoist upper block connected to the jib and a main hoist lower block. The main hoist lower block is assembled from a sheave block including the sheaves of the main hoist lower block and a load attachment assembly having the lowering weight and the main load attachment device. The crane vessel is provided with a load attachment assembly storage device for storage of the disassembled load attachment assembly and displacement means capable of engaging with and displacing the load attachment assembly while it is assembled to the sheave block and when the jib is supported by a jib rest.

14 Claims, 7 Drawing Sheets

CRANE VESSEL

Figure 1:
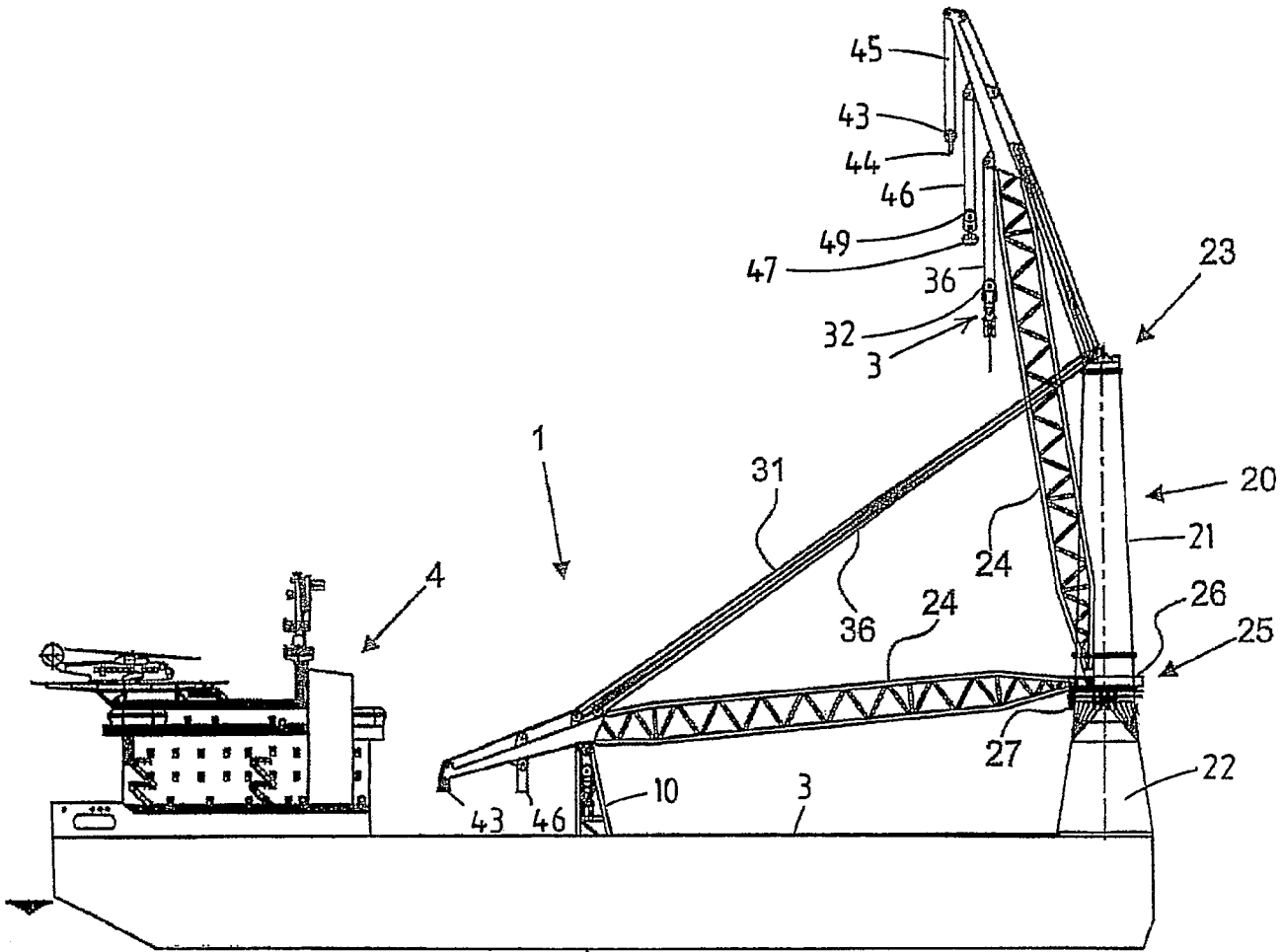

The invention relates to a crane vessel in accordance with the preamble of claim 1. Crane vessels comprising one or more revolving hoist cranes of this type have already been commercially available for decades. An example is shown in EP 1765717 of the present applicant.

In general, the main hoisting means on such vessels are designed to hoist the heaviest loads, and the auxiliary hoist, and a frequently provided so-called whip hoist are suitable to carry smaller loads. In daily practise on such crane vessels the crane is operated a substantive amount of time raising and lowering smaller loads that can be handled by the auxiliary hoist or whip hoist. During such operation, the main hoisting tackle hangs unused from the jib. The main hoist lower block is pulled upwards such that the main hoist lower block is close to the main hoist upper block and fixed there. In crane vessels the main hoist lower block is often intended for extreme loads, so that the total weight of the main lower block including the load attachment means, such as a hoisting hook, could be tens of tonnes, up to 300 tonnes. As this considerable dead weight is situated near the end of the jib, and thus remote from the slew-axis of the hoist crane, such a large weight negatively influences operation of the crane by increasing the inertia of this slewing operation. Another problem associated with such heavy crane blocks is that the block will tend to sway with respect to the jib, e.g. as the jib is slewed. Especially at rougher seas, swinging of the main hoist lower block may cause accidents. The swinging main hoist lower block can damage the jib and wires may get stuck behind them.

It is an object of the invention to propose an improved crane vessel of the type in accordance with the preamble of claim 1. To this end, the invention provides a crane vessel in accordance with the preamble of claim 1, which is characterised in that the main hoist lower block is assembled from a sheave block comprising the sheaves of the main hoist lower block and a load attachment assembly comprising the lowering weight and the main load attachment device, and in that the crane vessel is provided with a load attachment assembly storage device for storage of the disassembled load attachment assembly, and in that the crane vessel is further provided with displacement means capable of engaging and disengaging with the load attachment assembly while it is assembled to the sheave block and when the jib is supported by the jib rest, and which displacement means are capable of displacing the load attachment assembly to and from the load attachment assembly storage device.

This has the advantage that a substantive portion of the mass of the lowering weight and the main load attachment device can be left behind in the load attachment assembly storage device during hoist crane operation using the auxiliary hoisting means. This reduces the roll of the vessel due to crane slewing, because the total weight rotating about the vertical structure of the crane is less. The main load attachment device is preferably embodied as a main hook, but may alternatively be designed customized to the type of load that is hoisted.

In a preferred embodiment, the sheave block is pulled up and fixated with respect to the main hoist upper block, at least prior to engagement of the displacement means. When the sheave block is fixated with respect to the main hoist upper block during subsequent use of the hoist crane wile the load attachment assembly is stored, such fixation prevents swinging of the sheave block. As the sheaves remain attached to the hoist crane, re-rigging is not necessary which saves expensive operational time.

The invention further relates to a method of using a crane vessel according to the invention, comprising the steps of lowering the jib onto the jib rest, engaging the displacement means to the load attachment assembly, disassembling the load attachment assembly from the sheave block, and displacing the load attachment assembly to the load attachment assembly storage device.

Preferably, the method includes the steps of pulling up the sheave block and fixating it with respect to the main hoist upper block, lowering the jib onto the jib rest, engaging the displacement means to the load attachment assembly, disassembling the load attachment assembly from the sheave block, and displacing the load attachment assembly to the load attachment assembly storage device.

More preferably, the method further comprises the steps of lowering the jib onto the jib rest, displacing the load attachment assembly from the load attachment assembly storage device to the sheave block, assembling the load attachment assembly to the sheave block, and disengaging the displacement means from the load attachment assembly.

Further advantageous embodiments of the hoist crane according to the invention are described in the dependent claims and in the following description with reference to the drawing.

Figure 2:
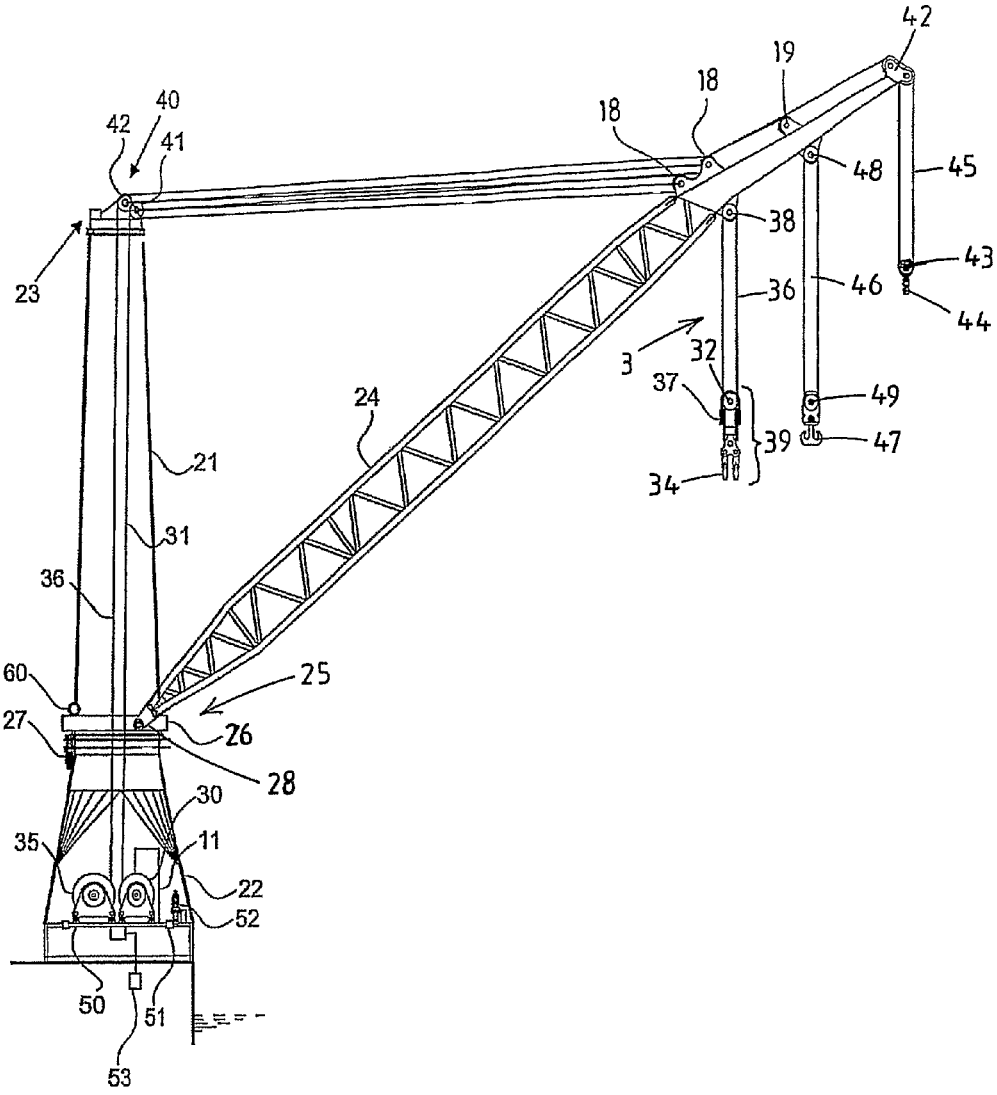
Figure 3:
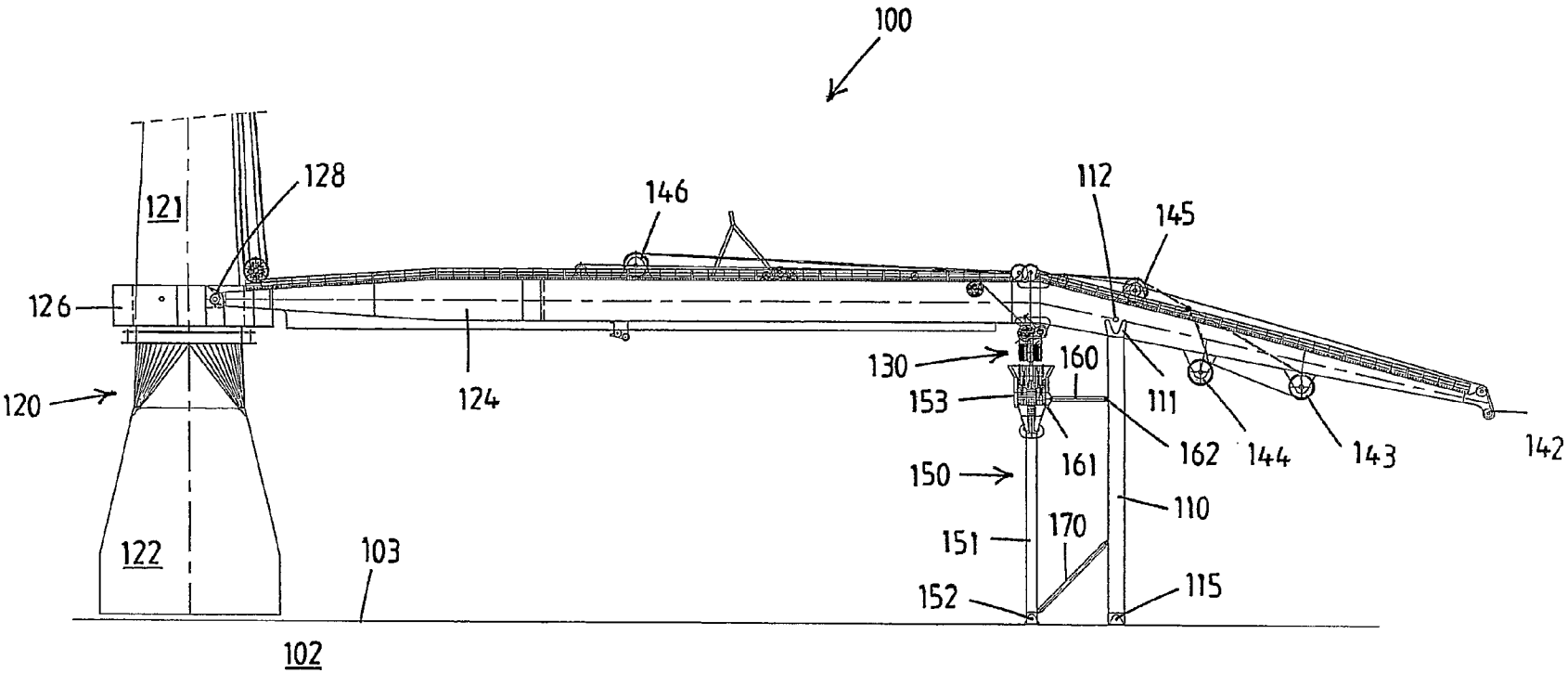
Figure 4B:
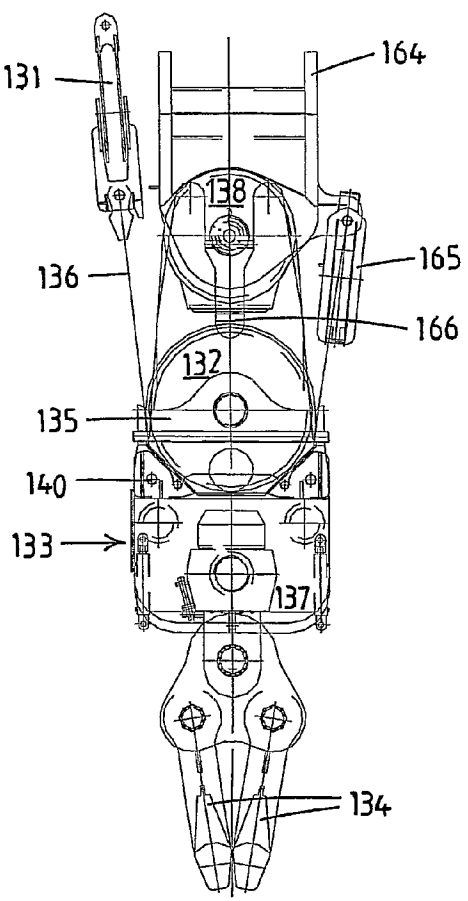
Figure 4A:
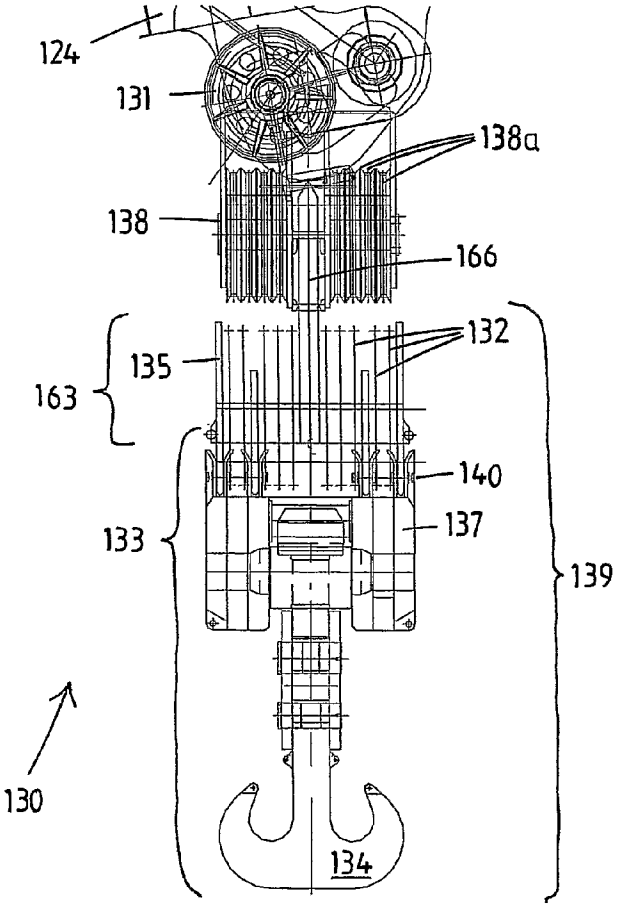
Figure 5B:
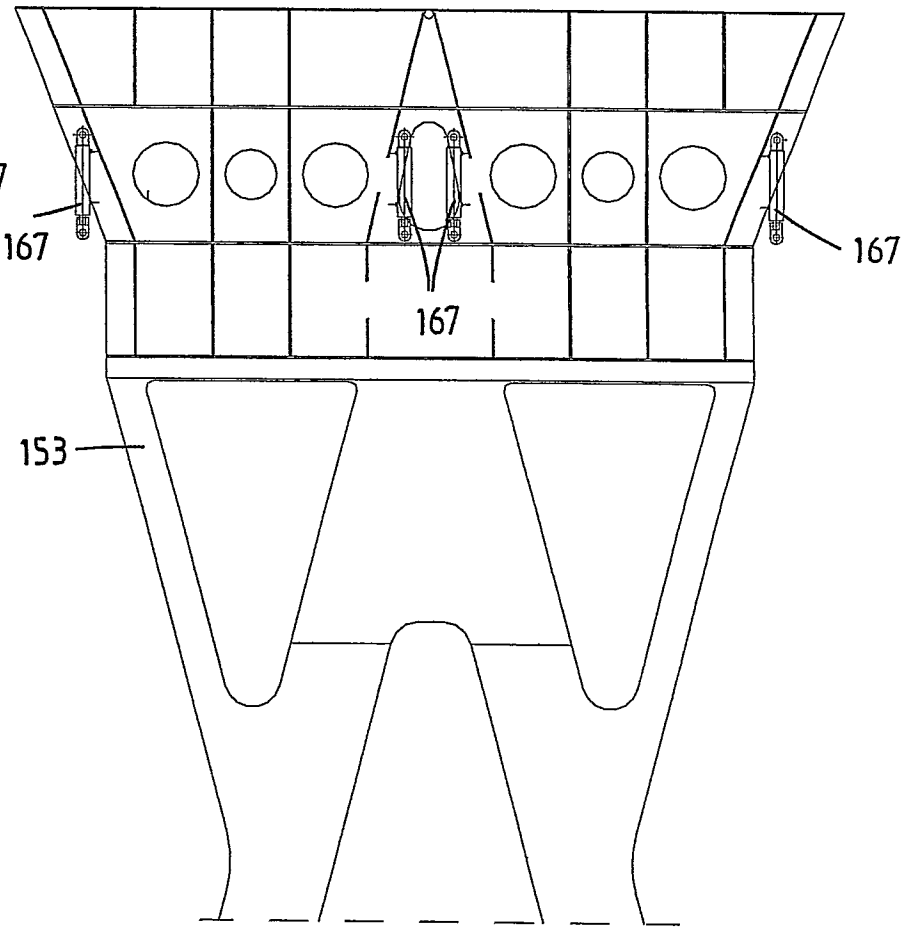
Figure 5A:
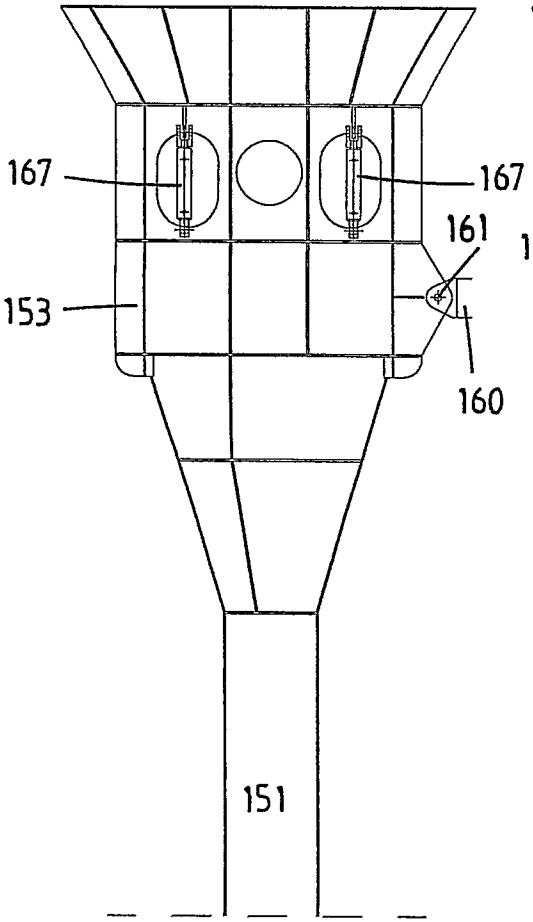
Figure 6C:
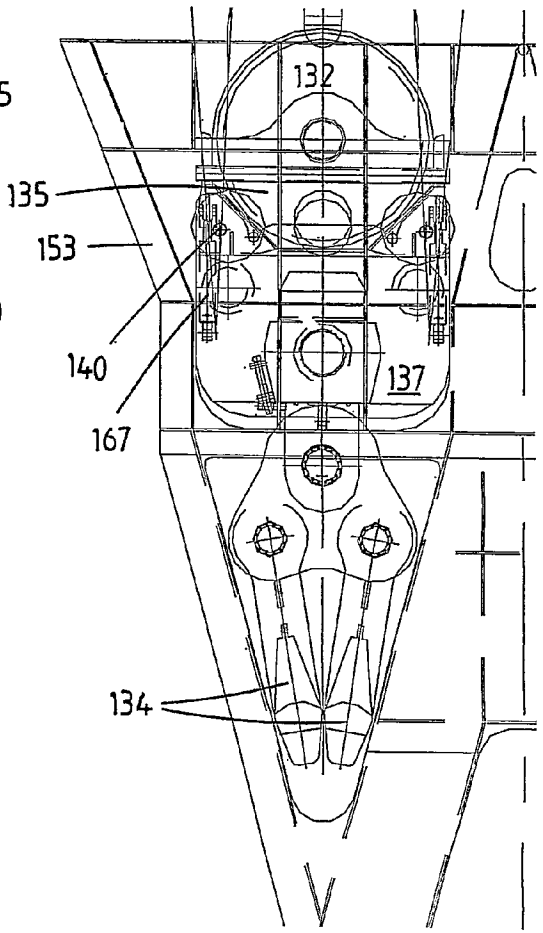
Figure 6B:
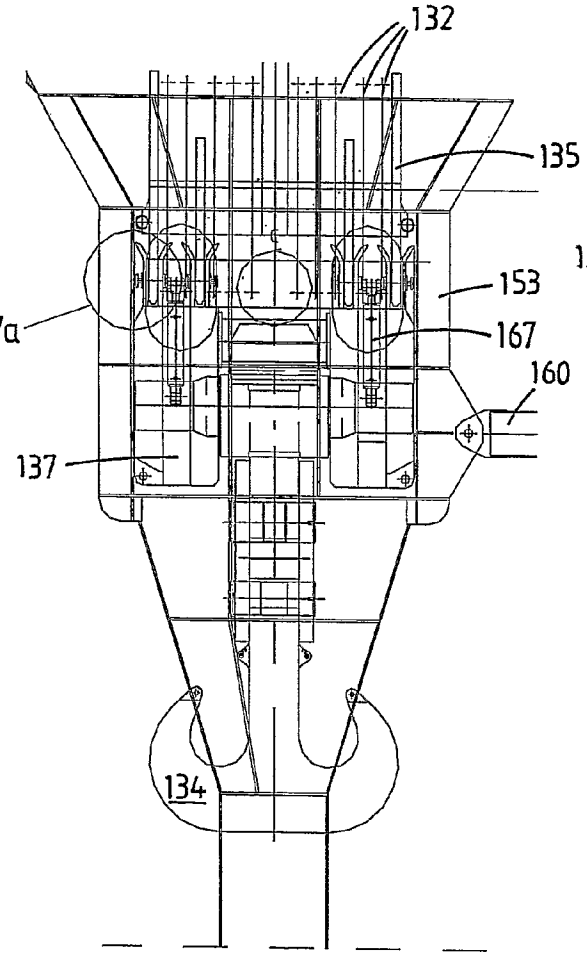
Figure 6A:
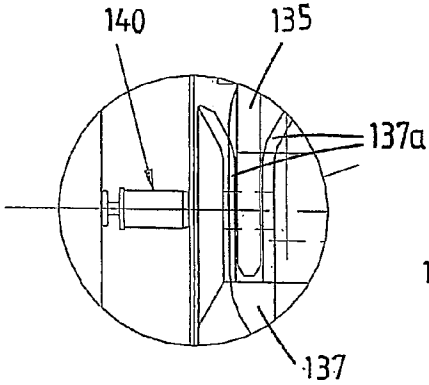
Figure 7:
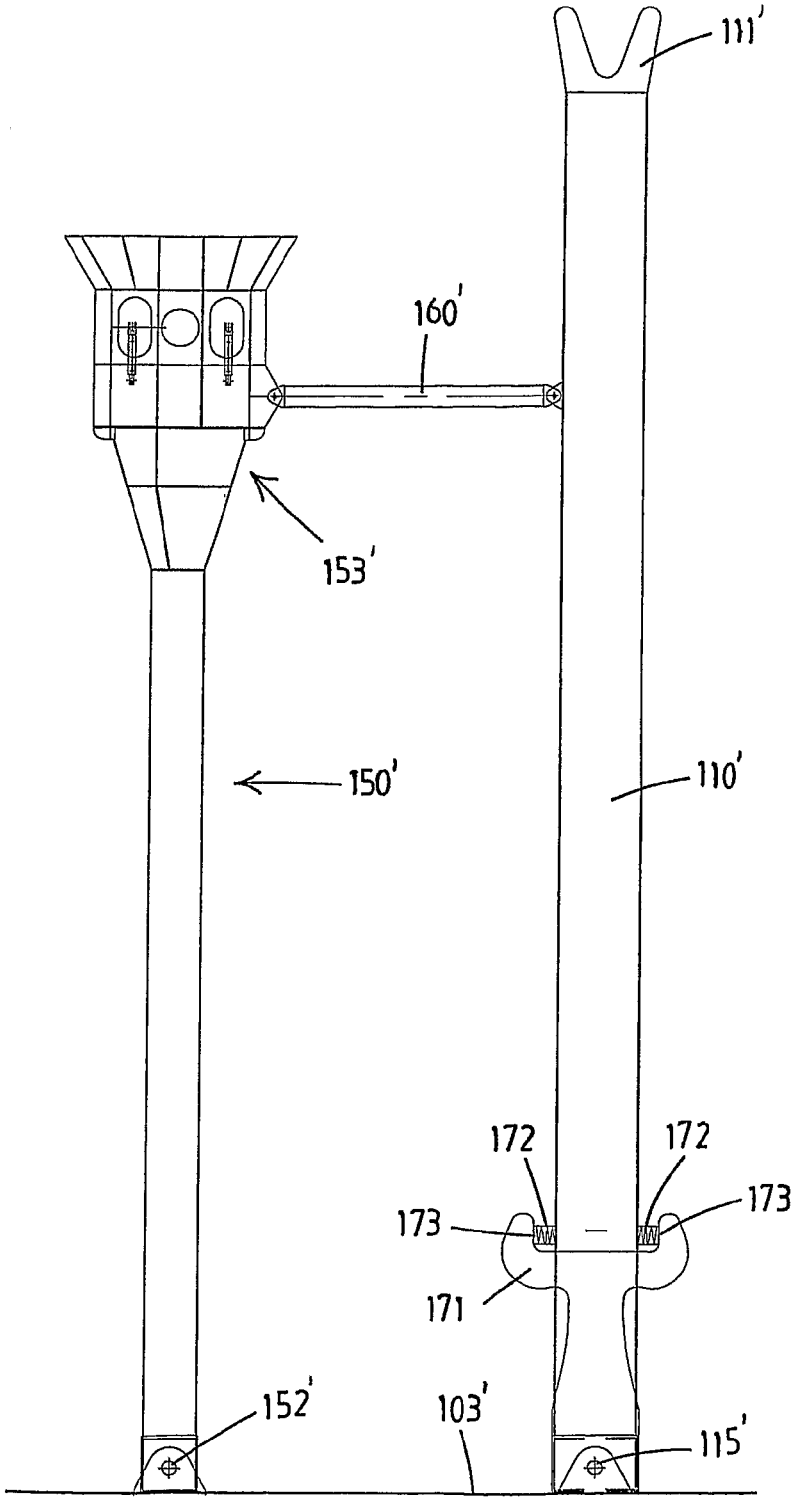

In the drawing:

FIG. 1 diagrammatically depicts a crane vessel,

FIG. 2 shows the hoist crane at the rear side of the vessel shown in FIG. 1, partially in the form of a cut-away view, FIG. 3 diagrammatically depicts an alternative crane vessel according to the invention, FIGS. 4*a* and 4*b* show a main hoist tackle according to the invention in detail from a front view and a side view, FIGS. 5*a* and 5*b* show a load attachment assembly storage device according to the invention in detail from a front view and a side view, FIGS. 6*a, b* and *c* show a main hoist lower block in a basket according to the invention in detail from a front view and a side view, FIG. 7 shows a detail of a load attachment assembly storage device and jib rest according to a preferred embodiment of the invention.

FIG. 1 schematically shows a crane vessel 1 according to the invention. The vessel 1 comprises a hull 2 with a working deck 3 and, at the front of the hull 2, a superstructure 4 for crew accommodation, etc.

Furthermore, the vessel 1 has a revolving hoist crane 20, in this example disposed at the rear end of the hull. The hoist crane 20, which is illustrated in detail in FIG. 2, has a substantially hollow vertical column 21 with a foot 22, which is fixed to the hull 2 of the vessel 1. Furthermore, the column 21 has a top 23.

The hoist crane 20 has a jib 24, which is illustrated in two different positions in FIG. 1. An annular bearing structure 25 extends around the vertical column 21 and guides and carries a jib connection member 26, so that the jib connection member 26, and therefore the jib 24, can rotate about the column 21.

In this case, the jib connection member 26 forms a substantially horizontal pivot axis 28, so that the jib 24 can also be pivoted up and down. There is at least one drive motor 27 for displacing the jib connection member 26 along the annular bearing structure 25. The drive motor 27 may, for example, drive a pinion which engages with a toothed track around the column 21.

A jib rest 10 is mounted to the hull 2 for supporting the jib when the crane 20 is not in operation, which position is also shown in FIG. 1. The jib rest 10 shown in FIG. 1 is very schematic, and will not be explained in further detail, but is, according to the invention, provided with a load attachment assembly storage device which is formed integral with the jib rest 10.

To pivot the jib 24 up and down, topping means are provided comprising a jib winch 30 and a jib hoisting cable 31 which engages on the jib 24.

Furthermore, the hoist crane 20 comprises a main hoisting winch 35 for raising and lowering a load, with an associated main hoisting cable 36 and a main hoisting tackle 3 comprising a main hoist upper block 38 mounted to the jib 24 of the hoist crane and a main hoist lower block 39 comprising a lowering weight 37, a main load attachment device in the form of a hoisting hook 34 and sheaves 32. Alternatively, the main load attachment device may be a ring suitable to connect a hook to. The lowering weight 37 is provided to ensure that the main hoisting cable 36 remains in tight contact with the sheaves, and to enable the lower main hoist lower block 39 to lower as a result of its own weight.

The shown main hoisting cable 36 extends from the main hoisting winch 35 via a main hoisting sheave assembly 18 on the jib and via the main hoist upper block 38 to the main hoist lower block 39. The main hoisting tackle with the main hoist lower block 39 according to the invention is shown in detail in FIGS. 4*a* and 4*b* and explained in further detail in relation to this figure.

Furthermore, the hoist crane 20 comprises an auxiliary hoisting winch (not shown) for raising and lowering a load, with an associated auxiliary hoisting cable 46 and an auxiliary sheave assembly 19 on the jib 24 of the hoist crane 20 and an auxiliary load attachment means 47. In the shown embodiment, the auxiliary hoisting means further comprise an auxiliary hoisting tackle comprising an auxiliary hoist upper block 48 suspending from the jib 24 of the hoist crane 20 and a lower block 49 comprising the auxiliary load attachment means 47. The auxiliary hoisting cable 46 extends from the auxiliary hoisting winch (not shown) via the auxiliary hoisting sheave assembly 19 and via the auxiliary hoist upper block 48 of the auxiliary hoisting tackle to the lower block 49 of the auxiliary hoisting tackle.

Furthermore, the shown embodiment of the hoist crane 20 comprises a whip hoisting winch (not shown) for raising and lowering a load, with an associated whip hoisting cable 45 and a whip hoisting sheave assembly 42 on the jib 24 of the hoist crane 20 and whip load attachment means 44. In the shown embodiment, the whip hoisting means further comprise a block 43 comprising the whip load attachment means 44. The whip hoisting cable 46 extends from the whip hoisting winch (not shown) via the whip hoisting sheave assembly 42 to the block 43 of the whip hoisting tackle.

At the top 23 of the column 21 there is a top cable guide 40 provided with multiple cable sheave assemblies 41 for the jib hoisting cable 31, main hoisting cable 36, auxiliary hoisting cable 46 and whip hoisting cable 45.

One or more cable sheave assemblies 18, 19 for the jib hoisting cable 31, main hoisting cable 36, auxiliary hoisting cable 46 and whip hoisting cable 45 may be arranged on the jib 24. The number of cable parts for each cable can be selected as appropriate by the person skilled in the art.

The winches 30 and 35, and possibly also the not shown auxiliary hoist winch and whip hoist winch, are in this case disposed in the foot 22 of the vertical column 21, so that the jib hoisting cable 31 and the hoisting cable 36 extend from the associated winch 30, upward, through the hollow vertical column 21 to the top cable guide 40 and then towards the sheave assembly 18, 19 on the jib 24.

In the shown embodiment, the top cable guide 40 has a rotary bearing structure, for example with one or more running tracks around the top of the column 21 and running wheels or rollers, engaging on the running tracks, of a structural part on which the sheave assemblies are mounted. As a result, the top cable guide can follow rotary movements of the jib about the vertical column 21 and adopt substantially the same angular position as the jib 24.

The top cable guide 40 may have an associated drive motor assembly which ensures that the top cable guide 40 follows the rotary movements of the jib 24 about the column 21, but an embodiment without drive motor assembly is preferred.

The winches 30 and 35, and the not shown auxiliary hoist winch and whip hoist winch, are in this embodiment arranged on a movable winch support 50, which is mounted movably with respect to the vertical column 21. The winch support 50 here is located in the vertical crane structure, preferably in the region of the foot 22 under the circular cross section part of the column 21, and is mechanically decoupled from the top cable guide 40. The support 50 could e.g. also be arranged in the hull of the vessel below the column, e.g. the foot could have an extension which extends into the hull.

In the example shown, the winch support 50 is a substantially circular platform which at its circumference is mounted in an annular bearing 51, with the winches arranged on the platform. The annular bearing 51 is in this case such that the platform can rotate about a vertical axis which coincides with the axis of rotation of the top cable guide. The bearing can have any appropriate design including trolleys running along a circular track.

The rotatable winch support 50 has an associated drive motor assembly 52 for moving the winch support 50, in such a manner that the winch support 50 maintains a substantially constant orientation with respect to the jib 24 in the event of rotary movements of the jib 24 about the vertical column 21. The orientation of the winch support 50 with respect to the top table guide 40 likewise remains substantially constant, since its movements are once again the consequence of rotary movements of the jib 24.

In the embodiment shown, there is an angle sensor 60 for detecting the position of the jib connection member 26 with respect to the vertical column 21, the drive motor assembly 52 of the winch support 50 having associated control means 53 which are in operative contact with the angle sensor 60.

The winches each have an associated electrical (or electro-hydraulic) winch drive motor assembly which is disposed on the movable winch support 50. The electrical energy required is supplied by generators disposed elsewhere on the vessel, at a distance from the movable winch support 50. One or more sliding contacts (not shown) are provided in the electrical connection between these generators and the winch drive motor assemblies.

In a variant which is not shown, the winch support 50 can rotate about a vertical shaft, this shaft being provided with one or more sliding contacts.

Via the one or more sliding contacts, a power current supply is preferably fed to the electrical equipment on the winch support 50.

It can be seen from the figures that, in this preferred embodiment, the vertical column 21 has a substantially continuous outer wall. In this case, the horizontal section through the vertical column is substantially circular from the jib connection member 26 to the top 23, with the cross section gradually decreasing towards the top of the column. The foot 22 of the column 21 is substantially rectangular, which has the advantage that the foot 22 can easily be secured (by welding or using bolts) to the longitudinal and cross bulkheads of the hull 2 of the vessel 1. Even more preferably, parts of the foot 22 of the crane may be formed integral with parts of the hull 2 of the vessel 1. In a variant which is not shown, the vertical structure is partly or completely a framework of bars.

In FIG. 3 an alternative schematic embodiment of a crane vessel 100 according to the invention is shown.

The vessel 100 comprises a hull 102 with a deck 103 and a revolving hoist crane 120. The hoist crane 120 comprises a vertical structure 121, 122 having a substantially hollow vertical column 121 and a foot 122 which is fixed to the hull 102. As the vertical structure 21 shown in FIGS. 1 and 2, the column 121 has a substantially continuous outer wall.

A jib 124 is mounted to a jib connection member 126 which is mounted rotatable about the vertical structure 121. The jib connection member 126 forms a substantially horizontal pivot axis 128 so that the jib 124 can be pivoted up and down. In FIG. 3 the jib is pivoted down to the lowermost position, in which the jib 124 is supported by a jib rest 110 mounted to the hull 102. The jib 124 is pivotable up and down by topping means (not shown), comprising a jib winch and a jib hoisting cable engaging with the jib 124.

The hoist crane 120 comprises main hoisting means, first and second auxiliary hoisting means and whip hoisting means.

The whip hoisting means comprise a whip hoist winch (not shown) and associated whip hoist cable (not shown), extending from the whip hoist winch to the whip hoist sheave assembly 142 provided at the end of the jib 124.

Both the first and second auxiliary hoisting means comprise first and second auxiliary hoist winches (not shown) and associated first and second auxiliary hoisting cables (not shown) extending from the winch to first and second auxiliary hoist cable sheave assemblies 143, 144, possibly guided by more sheave assemblies such as assemblies 145, 146.

The main hoisting means for raising and lowering a load comprise a main hoisting winch (not shown), an associated main hoisting cable (not shown) and a main hoisting tackle 130. The main hoisting tackle 130 is shown in detail in FIGS. 4*a* and 4*b* and will be explained further with respect to these drawings.

In FIG. 3 an example of a load attachment assembly storage device 150 according to the invention is shown, which is mounted to the hull 102 of the vessel close to the jib rest 110. The load attachment assembly storage device comprises a vertical column 151 which is mounted pivotably about pivot axis 152 to the deck 103 of the vessel. The load attachment assembly storage device further comprises a basket 153, which is connected to the jib rest 110 via a linkage 160 which is pivotable at both connection points 161, 162. The jib rest 110 is also mounted pivotably about pivot axis 115 to the deck 103 of the vessel. As a result of this parallelogram-construction, the jib rest 110 and the load attachment assembly storage device 150 are displaceable together in the horizontal direction, along the longitudinal axis of the vessel.

It is previously mentioned that the weight of the main hoist lower block including the lowering weight and the load attachment means, such as a hoisting hook could be tens of tonnes, up to 300 tonnes. It is therefore preferred to accurately position the load attachment assembly storage device 150 below at least the sheave block of the main hoisting tackle 130, such that the heavy load attachment assembly needs only be displaced in the vertical direction. Vertical displacement can preferably be performed by cylinders, provided in the load attachment assembly storage device, which are connectable to the load attachment assembly.

Due to temperature differences the jib 124 may expand and contract. The position of the sheave block, which is connected to the jib via the main hoist cable and the main hoist upper block of the main hoisting tackle, is thus also influenced by temperature. Furthermore, small deformations of the hull of the vessel may occur as a result of sea movements. With a load attachment assembly storage device 150 mounted to the hull 102 of the vessel, the relative position of the sheave block and the load attachment assembly storage device may thus deviate constantly.

Horizontal positioning of the load attachment assembly storage device opposite at least the sheave block requires horizontal displacement means and positioning means. Horizontal displacement may be performed by actuators acting on the load attachment assembly storage device, while positioning may be the responsibility of an operator and/or electronic sensors. Less preferred, but also conceivable is to displace the load attachment assembly to and from the load attachment assembly storage device via an addition crane.

Preferred and very accurate horizontal displacement means and positioning means are shown in FIG. 3. The jib rest 110 comprises a V-shaped catcher 111 for catching a pin 112 mounted on the jib 124. As a result of the parallelogram-construction, the jib rest 110 and the load attachment assembly storage device 150 are displaceable together along the longitudinal axis of the vessel to enable the pin 112 to be exactly positioned in the catcher 111. As such, reproducibly positioning of the jib 124 with respect to the jib rest 110 is assured, and thus also reproducibly positioning of the sheave block connected to the jib 124 opposite the load attachment assembly storage device 150, connected to the jib rest 110.

To maintain the jib rest 110 and the load attachment assembly storage device 150 in a substantial vertical default position, a cylinder 170 may be provided between the jib rest 110 and the load attachment assembly storage device 150 as shown in FIG. 3. Deviation from the default vertical position requires overcoming the piston force of the cylinder 170.

An alternative solution is shown in FIG. 7. Similar parts have been indicated with similar numbers, provided with a prime (′), a fixation frame 171 is fixed to the hull 103′ adjacent the pivotable jib rest 110′, which is pivotable about pivot axis 115′. The extent in which the jib rest 110′ is pivotable is limited by the fixation frame 171, which defines a stop surface 173 for the jib rest 110′. Between the stop surface 173 and the jib rest 110′, springs 172 are provided to position the jib rest 110′ in its default vertical position. Deviation from the default vertical position requires overcoming the spring force of the springs 172.

FIGS. 4*a* and 4*b* show a detailed view of an exemplary embodiment of a main hoist tackle 130 according to the invention, in front view in FIG. 4*a* and in side view in FIG. 4*b*.

The main hoisting tackle 130 comprises a main hoist upper block 138 mounted to the jib 124 of the hoist crane 120 and a main hoist lower block 139. A main hoist cable 136 runs from a main hoist winch (not shown) over one or more hoist cable sheave assemblies on the jib (not shown) and over a guide pulley 131 to the sheaves 132 of the main hoist lower block 139 and the sheaves 138*a* of the main hoist upper block 138. In the shown embodiment, the tackle 130 further comprises an equalizing sheave 165 which is regarded a common measure. The guide pulley 131 is mounted to the jib 124 via a frame part 164.

The main hoist lower block 139 comprises sheaves 132, a lowering weight 137 and, in this example, two main hooks 134 as main load attachment device. According to the invention, the main hoist lower block 139 is assembled from a sheave block 163 comprising a frame 135 with the sheaves 132 of the main hoist lower block 139 and a load attachment assembly 133 comprising the lowering weight 137 and the main load attachment device 134. The sheave block 163 is coupled to the load attachment assembly 133 via pins 140. The lowering weight 137 preferably has a rounded shape to facilitate storage in the basket 153 of the load attachment assembly storage device 150.

In the situation shown in FIGS. 4*a* and 4*b*, the main hoist lower block 139 including the sheave block 163 and the load attachment assembly 133 is pulled up towards the main hoist upper block 138. The sheave block 163 is fixated with respect to the main hoist upper block 138 via connection means 166.

According to the method according to the invention, the jib is lowered onto the jib rest, as is the situation shown in FIG. 3. Due to the parallelogram construction of the load attachment assembly storage device 150 and the jib rest 110 and due to the positioning means 111, 112 the main hoist lower block 139 is positioned exactly opposite the load attachment assembly storage basket 153. This situation is shown in detail in FIG. 6. It will be appreciated that other mobile constructions of the load attachment assembly storage device will allow for the same effects.

In FIGS. 5*a* and 5*b* the basket 153 of the load attachment assembly storage device 150 is shown in detail. As is visible from FIG. 5*b*, the basket of this embodiment is suitable to store two main hoist load attachment assemblies in parallel. The basket 153 is provided with cylinders 167, which are capable of engaging with the load attachment assembly while it is assembled to the sheave block when the jib is supported by the jib rest, and which is also capable of displacing the load attachment assembly in the vertical direction to and from the basket 153. The basket 153 has a tapered shape to facilitate positioning of the load attachment assembly 133 into the basket 153.

In FIG. 6, the load attachment assembly 133 is positioned above the basket 153 and mounted to the cylinders 167 provided in the basket 153. The cylinders 167 are preferably actuated such that the weight from the load attachment assembly 133 is transferred from the jib 124 to the load attachment assembly storage device 153.

Subsequently, the load attachment assembly 133 is disassembled from the sheave block 163 by removing pins 140 as is shown in FIG. 6*a*. In FIG. 6*a* it is also clearly visible that the load attachment assembly 133, and in particular the lowering weight 137, is provided with tapering protrusions 137*a* which may help in engaging with the frame part 135 of the sheave block 163.

The cylinders 167 are subsequently actuated to displace the load attachment assembly 133 to the load attachment assembly storage device 153 such that the load attachment assembly 133 rests in the basket 153. By moving the load attachment assembly 133 downwards and having the sheave block 163 connected to the main hoist upper block 138 the load attachment assembly 133 is separated from the sheave block 163.

Now, the crane vessel is ready for operation without the main hoisting means. If the main hoisting means are required again, the jib needs to be positioned on the jib rest again. The positioning means 111, 112 guarantee accurate positioning of the sheave block 163 opposite the basket 153.

Actuating the cylinders may lift the load attachment assembly 139 upwards, thereby positioning the frame part 135 of the sheave block 163 into the tapering protrusions 137*a* of the load attachment assembly 133. Now, the pins 140 may be positioned between the sheave block 163 and the load attachment assembly 133 to assemble them together to form the main hoist lower block 139. After disengaging the cylinders 167, the main hoist is ready for operation. The cylinders 167 remain in the basket 153.

The invention claimed is:

1. A crane vessel comprising a hull and a revolving hoist crane, the hoist crane comprising:

a vertical structure fixed to the hull, a jib, mounted to a jib connection member which is rotatable about the vertical structure, the jib connection member forming a substantially horizontal pivot axis so that the jib can be pivoted up and down, a topping device configured to pivot the jib up and down, the topping device comprising a jib winch and a jib hoisting cable engaging with the jib, a main hoisting device configured to raise and lower a load, the main hoisting device comprising:

a main hoisting winch, an associated main hoisting cable, and a main hoisting tackle, the main hoisting tackle comprising:

a main hoist upper block connected to the jib of the hoist crane, and a main hoist lower block, the main hoist lower block comprising sheaves, a main load attachment device, and a lowering weight, an auxiliary hoisting device configured to hoist a load, comprising an auxiliary hoisting winch, an associated auxiliary hoisting cable and an auxiliary load attachment device; and a jib rest mounted to the hull for supporting the jib when the crane is not in operation, wherein the main hoist lower block is assembled from a sheave block comprising the sheaves of the main hoist lower block and a load attachment assembly comprising the lowering weight and the main load attachment device, the crane vessel is provided with a load attachment assembly storage device for engaging the sheave block and for storage of the disassembled load attachment assembly, and in that the crane vessel is further provided with a displacement device capable of engaging and disengaging with the load attachment assembly while it is assembled to the sheave block and when the jib is supported by the jib rest, wherein the displacement device is capable of displacing the load attachment assembly to and from the load attachment assembly storage device and the sheave block, and wherein the load attachment assembly storage device is provided with horizontal displacement means for horizontal displacement of the load attachment assembly storage device and with positioning means to position the load attachment assembly storage device opposite at least the sheave block.

2. The crane vessel according to claim 1, wherein the displacement device is provided in the load attachment assembly storage device.

3. The crane vessel according to claim 2, wherein the sheave block is provided with a fixation device to fixate the sheave block with respect to the main hoist upper block, and in which the jib and the jib rest are provided with a positioning device for reproducibly positioning the jib on the jib rest, and thus reproducibly positioning the sheave block opposite the load attachment assembly storage device.

4. The crane vessel according to claim 1, wherein both the load attachment assembly storage device and the jib rest are mounted pivotable to the hull of the vessel, and connected to each other via a linkage which is pivotable at the connection points with the load attachment assembly storage device and the jib rest, such that both the jib rest and the load attachment assembly storage device are displaceable together in a horizontal direction, along the longitudinal axis of the vessel.

5. The crane vessel according to claim 4, wherein the sheave block is provided with a fixation device to fixate the sheave block with respect to the main hoist upper block, and in which the jib and the jib rest are provided with the positioning means for reproducibly positioning the jib on the jib rest, and thus reproducibly positioning the sheave block opposite the load attachment assembly storage device.

6. The crane vessel according to claim 4, wherein the sheave block is provided with a fixation device to fixate the sheave block with respect to the main hoist upper block, and in which the jib and the jib rest are provided with a positioning device for reproducibly positioning the jib on the jib rest, and thus reproducibly positioning the sheave block opposite the load attachment assembly storage device.

7. The crane vessel according to claim 1, wherein the load attachment assembly storage device is formed integral with the jib rest.

8. The crane vessel according to claim 1, wherein the sheave block and the load attachment assembly are assembled together via pins.

9. The crane vessel according to claim 1, wherein the vertical structure comprises a substantially hollow vertical column with a foot which is fixed to the hull.

10. The crane vessel according to claim 9, wherein the foot of the column is substantially rectangular, and parts of the foot are formed integral with parts of the hull of the vessel.

11. The crane vessel according to claim 1, in which the sheave block is provided with fixation means to fixate the sheave block with respect to the main hoist upper block.

12. The crane vessel according to claim 11, wherein the displacement device is provided in the load attachment assembly storage device.

13. The crane vessel according to claim 11, wherein the sheave block is provided with a fixation device to fixate the sheave block with respect to the main hoist upper block, and in which the jib and the jib rest are provided with a positioning device for reproducibly positioning the jib on the jib rest, and thus reproducibly positioning the sheave block opposite the load attachment assembly storage device.

14. A crane vessel comprising a hull and a revolving hoist crane, the hoist crane comprising:

a vertical structure fixed to the hull, a jib, mounted to a jib connection member which is rotatable about the vertical structure, the jib connection member forming a substantially horizontal pivot axis so that the jib can be pivoted up and down, a topping device configured to pivot the jib up and down, comprising a jib winch and a jib hoisting cable engaging with the jib, a main hoisting device configured to raise and lower a load, comprising:

a main hoisting winch, an associated main hoisting cable, and a main hoisting tackle, the main hoisting tackle comprising:

a main hoist upper block connected to the jib of the hoist crane, and a main hoist lower block, the main hoist lower block comprising sheaves, a main load attachment device, and a lowering weight, an auxiliary hoisting device configured to hoist a load, comprising an auxiliary hoisting winch, an associated auxiliary hoisting cable and an auxiliary load attachment device;

and wherein a jib rest is mounted to the hull for supporting the jib when the crane is not in operation, wherein the main hoist lower block is assembled from a sheave block comprising the sheaves of the main hoist lower block and a load attachment assembly comprising the lowering weight and the main load attachment device, and in that the crane vessel is provided with a load attachment assembly storage device for engaging the sheave block and for storage of the disassembled load attachment assembly, and in that the crane vessel is further provided with a displacement device capable of engaging and disengaging with the load attachment assembly while it is assembled to the sheave block and when the jib is supported by the jib rest, wherein the displacement device is capable of displacing the load attachment assembly to and from the load attachment assembly storage device and the sheave block, wherein the sheave block is provided with a fixation device to fixate the sheave block with respect to the main hoist upper block, and the jib and the jib rest are provided with a positioning device configured to reproducibly position the jib on the jib rest, and thus reproducibly positioning the sheave block opposite the load attachment assembly storage device.

* * * * *